US006991557B2

(12) United States Patent
Lisby, Jr.

(10) Patent No.: US 6,991,557 B2
(45) Date of Patent: Jan. 31, 2006

(54) GOLF BALL RETRIEVAL AND BALL MARK REPAIR TOOL

(76) Inventor: Howard W. Lisby, Jr., 5504 Lea Crest La., Fort Worth, TX (US) 76135

( * ) Notice: Subject to any disclaimer, the term of this patent is extended or adjusted under 35 U.S.C. 154(b) by 94 days.

(21) Appl. No.: 10/618,921

(22) Filed: Jul. 14, 2003

(65) Prior Publication Data

US 2005/0014572 A1 Jan. 20, 2005

(51) Int. Cl.
*A63B 47/02* (2006.01)

(52) U.S. Cl. ..... 473/282; 473/286; 294/19.2

(58) Field of Classification Search ..... 473/282, 473/286, 408–409; D21/793–796; 211/70.2; 294/19.2; 172/378; 248/688
See application file for complete search history.

(56) References Cited

U.S. PATENT DOCUMENTS

| | | | | |
|---|---|---|---|---|
| 1,674,294 A | | 6/1928 | O'Rourke | |
| 2,432,906 A | | 12/1947 | Klingler | 294/19 |
| 2,801,875 A | | 8/1957 | McEvoy | 294/19 |
| 3,239,264 A | | 3/1966 | DuPont | 294/19 |
| 3,462,184 A | | 8/1969 | Russell | 294/19 |
| 3,771,794 A | | 11/1973 | Crockett | 273/162 |
| 4,545,579 A | * | 10/1985 | McCain | 473/282 |
| 4,787,632 A | | 11/1988 | Nigrelli et al. | 273/32 B |
| 4,951,947 A | | 8/1990 | Kopfle | 273/32.5 |
| 5,423,543 A | * | 6/1995 | Tarrant | 473/286 |
| 5,437,449 A | | 8/1995 | Zink | 273/32 B |
| 5,520,389 A | | 5/1996 | Furrow | 473/286 |
| 5,545,579 A | | 8/1996 | Liang et al. | 273/162 R |
| 6,257,635 B1 | * | 7/2001 | Torelli | 294/19.2 |
| 6,364,787 B1 | * | 4/2002 | Huiskamp | 473/294 |
| 6,390,931 B1 | * | 5/2002 | Berndt | 473/282 |

* cited by examiner

*Primary Examiner*—Stephen Blau
(74) *Attorney, Agent, or Firm*—Guy V. Manning

(57) ABSTRACT

A tool mounted to the end of a golf club or other handle serves as means for retrieving a golf ball, for repairing a golf ball or club mark on the playing surface and for preventing the club grip from contacting the ground when the club is laid horizontally. The tool comprises a head detachably connected to the grip end of a golf club. In a preferred embodiment, the head includes a tang which fits into a slotted plug in the end of the club shaft under the grip. In an alternate embodiment, the head includes a yoke that cups over the outer radius of the golf club grip and is held in place by an external strap. The head has three flat surfaces serving as a shelf for lifting the golf ball and two walls forming a corner for the ball to rest against and for keeping the ball captive during the retrieval process. Two prongs protrude from the shelf for repairing ball marks. These two prongs or the body of the tool also serve to hold the grip off the ground when the club is laid horizontally.

25 Claims, 5 Drawing Sheets

1
10
7
8
9
13
3
21
A 9
9
7
3
13
18
5
4
25
4
17
26
21
A 2
19
17
21
25
2

3
3
A
1
21
23
25
27

GOLF BALL RETRIEVAL AND BALL MARK REPAIR TOOL

BACKGROUND OF THE INVENTION

1. Field of the Invention

This invention relates generally to golf club accessories, and specifically to golf ball retrieval tools. More specifically it relates to a golf ball retrieval tool which doubles as a ball mark repair tool and a spacer for keeping the club grip clean and dry when the club must be laid on the ground.

2. Description of Related Art

Any golfer is familiar with the number of times one must bend over to retrieve a golf ball, for example, once it is holed or when it must be moved to allow other players to continue play on the green. Bending also is required to repair ball or club impact marks made to the soft surface of the putting green or divots on the fairway. Playing 18 holes of golf can result in bending for these activities in excess of sixty times. For some golfers, this represents a physical burden which might prevent them from playing. At least for such golfers, a need exists for means to reduce the number of times they must bend and stoop during a round of golf.

Putting greens and the surfaces near them often are very soft and cannot support the weight of a golf cart. In route on foot to the putting green, a golfer often brings two or more clubs if the golf ball is not yet on the putting green surface, a putter and at least one additional club. While using one of the clubs, a golfer must put the other aside, typically by simply laying it on the ground nearby. Preferably the club grip should remain clean and dry, but it is common for the area near the putting green to be wet from watering, rain or morning dew. A need exists for means for keeping the grip from contacting the ground when a club is laid on the ground.

A number of different types of golf ball retrievers are available, including some that attach to a club grip. Some include a spring device intended to grasp the golf ball, while others use a scoop to contain the ball. With most of these devices, however, it is difficult to secure the ball to start the lifting process or to release the ball once it is lifted. Very few include a ball mark repair tool or appear to be intended to help keep a club grip clean.

SUMMARY OF THE INVENTION

Accordingly, it is an object of this invention to provide a tool or accessory for retrieving a golf ball.

It is another object of this invention to provide a tool or accessory for repairing a golf ball mark made on the playing surface without the need to stoop to do so.

It is another object of this invention to provide a tool or accessory to prevent the grip of a golf club from contacting the ground when the club is laid horizontally.

It is yet another object of this invention to provide a tool attached to the grip of the club itself for ball retrieval, ball mark repair and for keeping the grip off the ground.

The foregoing and other objects of this invention are achieved by providing a tool mounted to the end of a golf club or other handle, the tool serving as means for retrieving a golf ball, for repairing a golf ball or club mark on the playing surface and for preventing the club grip from contacting the ground when the club is laid horizontally. The tool comprises a head detachably connected to the grip end of a golf club. In a preferred embodiment, the head includes a tang which fits into a slotted plug in the end of the club shaft under the grip. In an alternate embodiment, the head includes a yoke that cups over the outer radius of the golf club grip and is held in place by an external strap. The head has three flat surfaces serving as a shelf for lifting the golf ball and two walls forming a corner for the ball to rest against and for keeping the ball captive during the retrieval process. Two prongs protrude from the shelf for repairing ball marks. These two prongs or the body of the tool also serve to hold the grip off the ground when the club is laid horizontally.

BRIEF DESCRIPTION OF THE DRAWINGS

The novel features believed characteristic of the present invention are set forth in the appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figures 1, 2, 3, 4:
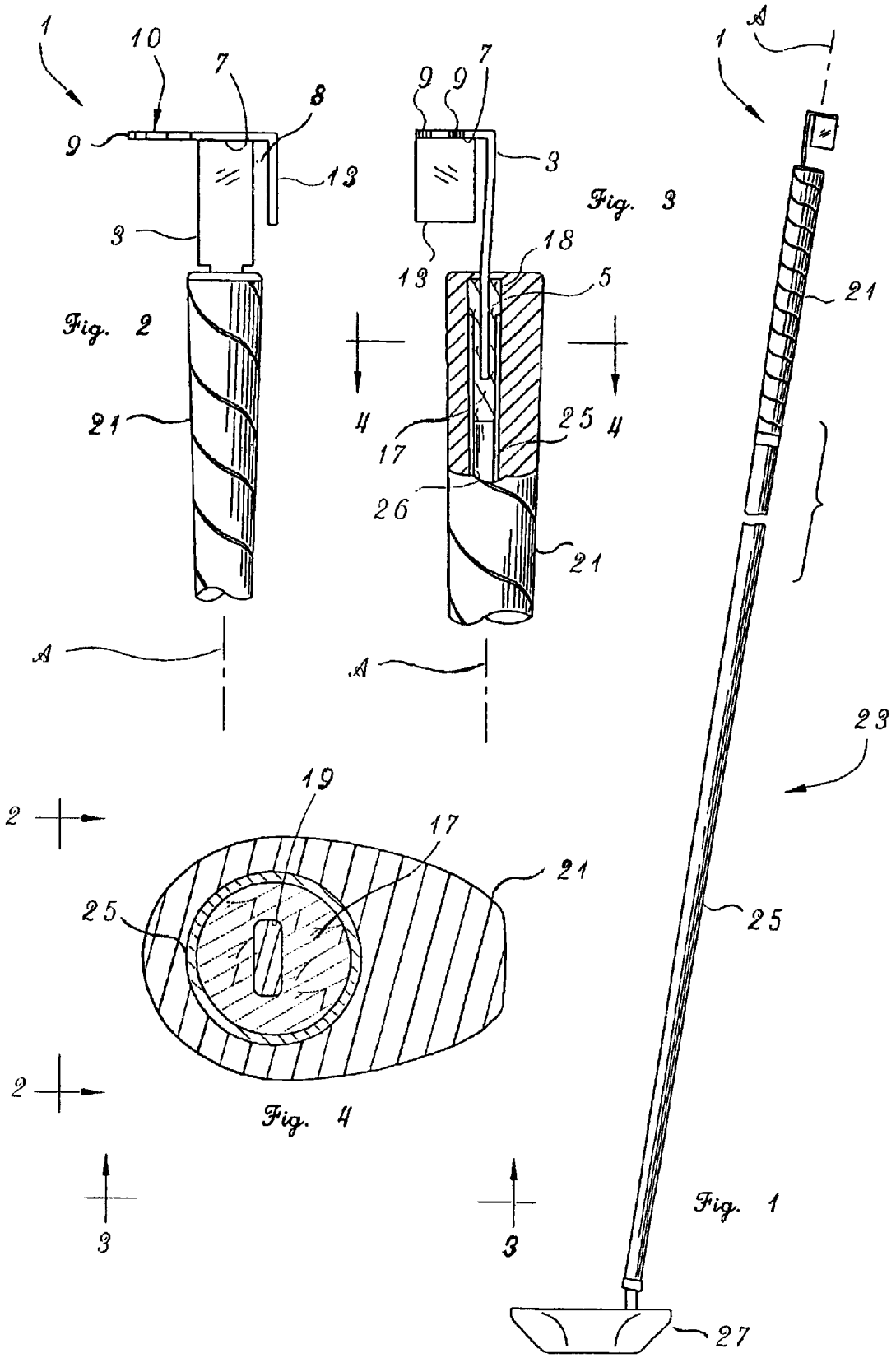
FIG. 1 depicts a golf club with a preferred embodiment of the ball retrieval tool of the present invention installed into the end of the grip.
FIG. 2 shows, as indicated in FIG. 4, the grip end of the club in FIG. 1.
FIG. 3 details in cutaway view, as indicated in FIG. 4, the preferred embodiment of the golf ball retrieval tool of FIG. 2 installed in an alternate manner in the grip end of the club.
FIG. 4 is a transverse cross section through the grip end of a golf club, as indicated in FIG. 3, with the preferred embodiment of FIG. 2 installed therein.
Figure 1A:
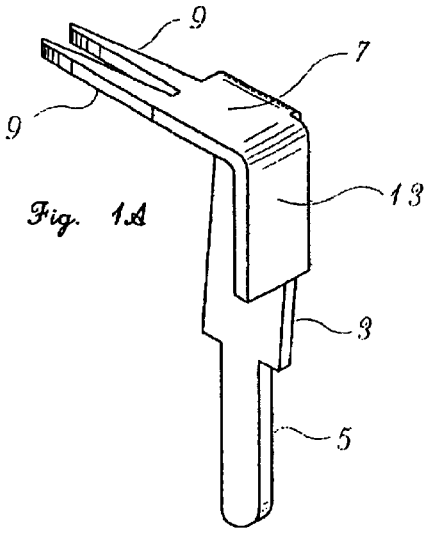
FIG. 1A depicts in perspective the preferred embodiment of FIG. 1 prior to installation into the end of the grip.

With reference now to the figures, and in particular to FIGS. 1, 1A, 2 and 3, club 23 is shown comprising shaft 25 having head 27 on one end and grip 21 on its opposite end. Tool 1 is shown installed into grip 21 end of club 23 substantially coaxial with axis A of shaft 25. It will be noted here and further discussed below that tool 1 as depicted in FIG. 1 lies substantially within a projected profile (not shown) of the sides of grip 21. Also, club 23 is depicted in FIG. 1 as a type of golf club known as a putter, but one having ordinary skill in the art will recognize that club 23 could be any club used by or commonly available to golfers, or alternatively, club 23 could be a specialized handle dedicated to tool 1. As hereinafter used, references to club 23 shall mean any such handle means adapted to be employed with either embodiment of the present invention.

Tool 1 comprises body 3 extending substantially coaxially from the end of grip 21. Tool 1 further includes shelf 7 disposed on the end of body 3 distal grip 21 and substantially at a right angle to body 3. Backstop 13 is disposed at one end of shelf 7 and at a substantially right angle to both shelf 7 and body 3, thereby forming with them an interior, three-sided corner. One having ordinary skill in the art also will recognize that this three-sided corner comprises means for receiving and retaining a golf ball when club 23 is inverted (see FIG. 9), thus positioning tool 1 beneath shaft 25 such that the ball rests on shelf 7 and against body 3 and backstop 7.

Gap 8 is shown between backstop 13 and body 3 and having a width substantially smaller than backstop 13 or body 3. The width of gap 8 is somewhat a matter of expediency and convenience, but it is chosen with two constraints in mind. First, it must be smaller than the diameter of a golf ball, obviously so that the golf ball cannot pass through gap 8. Secondly, gap 8 preferably is wide enough that it is adapted temporarily to receive storage means such as a strap or belt loop. This allows golfer 35 to remove tool 1 while using club 23 and to clip tool 1 onto a golf bag strap or his belt (neither shown) by inserting the strap or belt into gap 8, thus keeping tool 1 handy for use once golfer 35 needs it. Thus, within these constraints, gaps of any size are considered within the scope of the present invention.

Extending opposite backstop 13 from shelf 7, a plurality of prongs 9 form fork 10, a projection used for repairing ball marks. Shown as substantially in the same plane as shelf 7, each of two prongs 9 preferably extends approximately two (2") inches and tapers to a point. Prongs 9 thus rather easily penetrate the ground beneath a ball mark, enabling golfer 35 to lift the compressed earth below said ball mark without causing significant damage from the penetration by prongs 9. One having ordinary skill in the art will recognize that various configurations of fork 10 may be employed within the spirit and scope of the invention.

With further reference to FIGS. 1A, 2, 3 and 4, body 3 is shown coupled to shaft 25 by way of a narrowed portion, or tang 5 frictionally and snugly received within slot 19 of plug 17. Tang 5 is illustrated in the figures as having a substantially rectangular cross section with semicircular opposite ends, but may comprise other cross sections, including use of multiple tangs (not shown), without departing from the spirit and scope of the present invention. In the preferred embodiment, tang 5 preferably fits snugly enough within slot 19 that no further securing means are necessary, yet tool 1 easily may be removed from shaft 25 with reasonable axial force. One having ordinary skill in the art will recognize, however, that any securing or coupling means are within the spirit and scope of the present invention.

Hollow interior 26 of shaft 25 typically has a circular cross section and may have parallel walls resulting in a regular cylinder shape, or it may be conically shaped if shaft 25 tapers from grip 21 to head 27. Interior 26 also may have non-circular cross sections (not shown), such as rectangular or square, usually where the exterior of shaft 25 so varies. Finally, shaft 25 may be solid and have no interior 26 (not shown), in which case slot 19 is formed directly into the end of shaft 25. One having ordinary skill in the art will recognize that any and all such variations in shaft 25 are considered within the spirit and scope of the present invention, with concomitant variations resulting in plug 17.

Within interior 26 at grip 21 end of shaft 25, plug 17 comprises a prefabricated cylinder of solid but malleable material, preferably wood or plastic, into which slot 19 is formed. Plug 17 has a diameter adapted to fit tightly enough within interior 26 of shaft 25 that said reasonable axial withdrawing force employed to remove tang 5 from slot 19 does not move plug 17 within interior 26. If necessary to achieve this result, adhesive may be employed between plug 17 and interior 26. Alternately, plug 17 may comprise an epoxy or other admixture poured into interior 26 at the end of shaft 25, with either a removable block to create slot 19, or with slot 19 later being drilled into plug 17 after the admixture sets. In any case, plug 17 must be tight enough within shaft 25 that it cannot easily be shoved further into interior 26 by insertion of tang 5 into slot 19.

One means of assuring this is for plug 17 to include cap 18 which has an outside diameter larger than the interior of shaft 25, preferably substantially equal to the outside diameter of shaft 25. When golfer 35 inserts tang 5 into slot 19 and pushes it axially into grip 21, cap 18 bears against the end of shaft 25 and prevents plug 17 from moving. One having ordinary skill in the art will recognize that cap 18, in combination with frictional or adhesive contact between grip 21 and shaft 25, allows some tolerance in the fit between plug 17 and interior 26. This has the advantage of permitting plug 17 easily to be removed if necessary once grip 21 is removed from club 23.

Turning again to tool 1 as shown in FIGS. 1 and 3, a slight offset is apparent in body 3 between shelf 7 and grip 21. This offset serves to position shelf 7 and backstop 13 slightly askew from axis A of shaft 25. Such offset abets the following advantages.

As mentioned above, FIG. 1 shows tool 1 installed into shaft 25 oriented such that it projects substantially within a projected profile of grip 21. In FIG. 3, however, tool 1 does not lie within such projected profile of grip 21, but is offset to one side of grip 21, partially due to the offset in body 3 described above. Tool 1 thus may be installed in either of two orientations that are 180 degrees apart based on golfer 35's preference. Such preference would depend upon which way golfer 35 wished the above described three-sided corner to face, largely defined by which way golfer 35 found it easier to use tool 1 or by whether golfer 35 is left or right handed. Experiments have shown that some golfers prefer better visibility of the golf ball and tool 1 gained by the orientation shown in FIG. 3, while others prefer the sleeker profile of the orientation of FIG. 1.

Tool 1 preferably is fabricated from a single piece of flat, one-eighth (⅛") inch sheet steel, cut with the profiles of its component parts, tang 5, body 3, shelf 7, backstop 13 and prongs 9 and bent at the joinder points of those components. This size of steel is chosen for a preferred balance of rigidity and light weight, but one having ordinary skill in the art will recognize that other combinations of thickness of steel may be substituted. One having ordinary skill in the art also will recognize that tool 1 could be fabricated from separate components later attached as described. Further, tool 1 alternately could be molded as a single object from a thermoset plastic such as styrene or cross-linked polyethylene having rigidity comparable to the preferred sheet steel specified while being considerably lighter and less expensive to fabricate.

Figure 5:
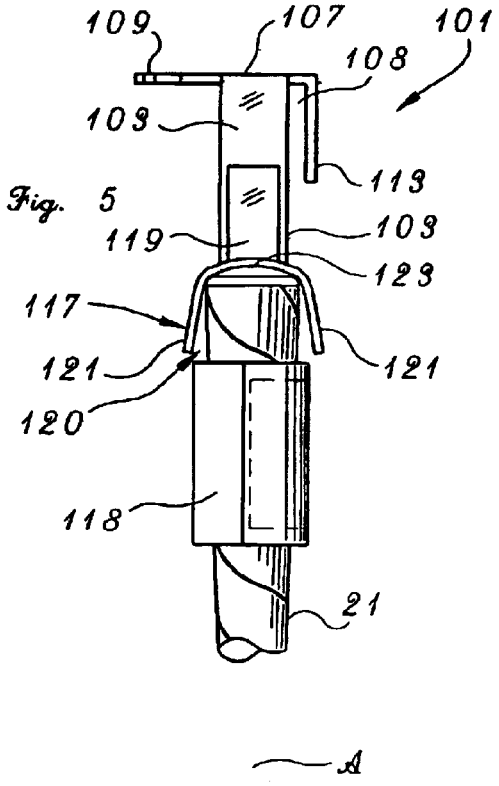
FIG. 5 shows, viewed as indicted in FIG. 7, an alternate embodiment of the present invention, wherein the golf ball retrieval tool is attached to the exterior of the club grip with an attachment strap.
Figure 6:
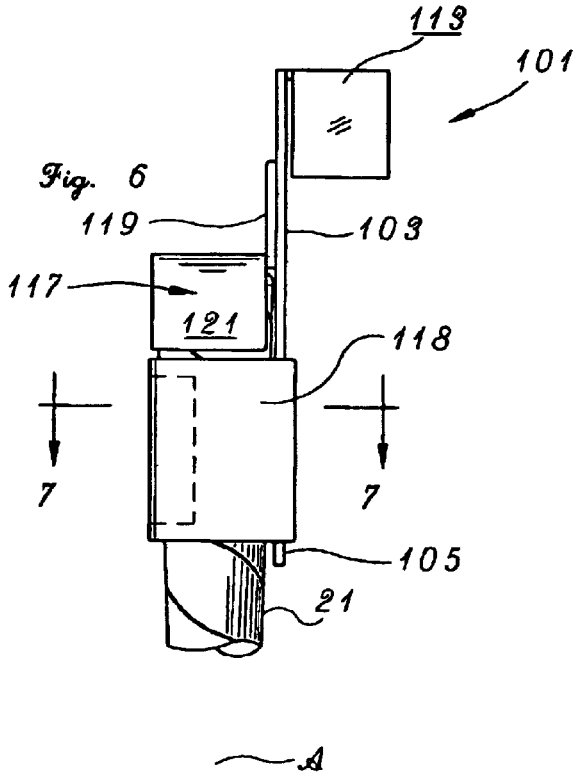
FIG. 6 shows the alternate embodiment of FIG. 5 viewed as indicated in FIG. 7.
Figure 7:
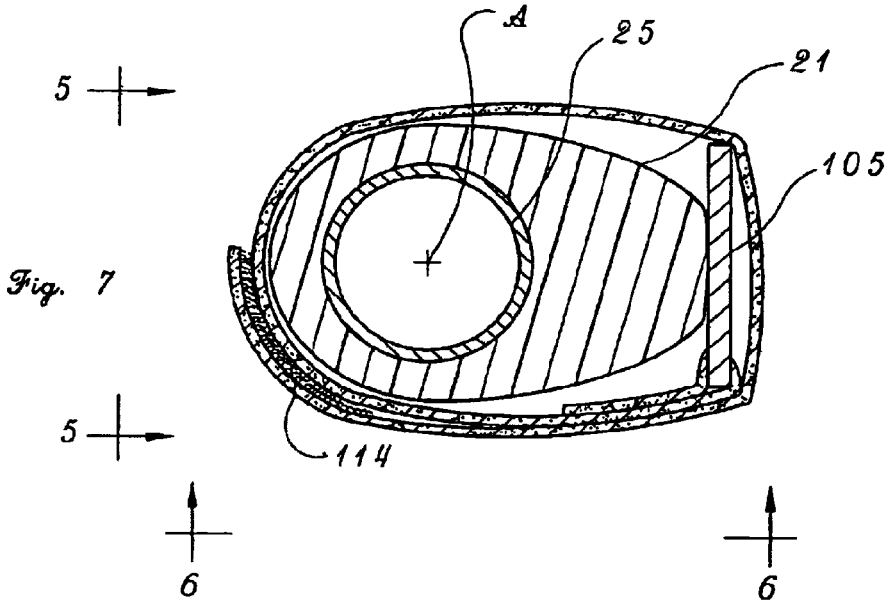
FIG. 7 is a transverse cross section through the grip end of a golf club, as indicated in FIG. 6 and showing the alternate embodiment of FIG. 5 installed thereon.

Turning now to FIGS. 5, 6 and 7, an alternate embodiment of the present invention, tool 101, is depicted which couples to the outside of grip 21. This alternate embodiment allows golfer 35 to attach tool 101 to any golf club 23 without the need to modify the club in any manner.

As with the preferred embodiment described above, tool 101 comprises body 103 having shelf 107 disposed on one end thereof distal grip 21. Backstop 113 is disposed on one end of shelf 107 perpendicular to both shelf 107 and body 103, forming gap 108. Prongs 109 extend substantially coplanar with shelf 107 opposite backstop 113. These features are configured and used in similar fashion as described above for corresponding features of the preferred embodiment, and will not be discussed again except as they deviate therefrom.

Unlike the preferred embodiment, tool 101 does not include tang 5 for fitting within plug 19 within shaft 25. Instead, body 103 extends longitudinally away from shelf 107 to form shank 105. Attached to shank 105 is strap 118 which wraps around grip 21 and fastens with fastener 114 to hold shank 105 against one side of grip 21. Preferably, shank 105 comprises a continuous extension of body 103, also preferably made from one piece of sheet metal as are shelf 107, backstop 113 and prongs 109. Shank 105 may be flat or longitudinally concave (not shown) to better fit the curvature of the side of grip 21.

Attachment strap 118 is layered approximately one and one half turns around grip 21 and coupled with fastener 114. Strap 118 comprises a flexible fabric type material, preferably leather, with fastener 114 stitched to strap 118. Fastener 114 preferably comprises hook and loop strips commonly known as VELCRO, but one having ordinary skill in the art will recognize that fastener 114 also could be snaps, buttons, string ties or other commonly available fastening means without departing from the spirit and scope of the invention.

Coupled to one side of body 103 opposite shelf 107, yoke 117 has a generally U-shaped mouth 120 between sidewalls 121 and opposite bottom 123, yoke 117 thereby opening away from shelf 107 and toward grip 21. Yoke 117 presses onto the end of grip 21 to affix the axial position of tool 101 on club 23. Yoke 117 couples to body 103 by tongue 119 which attaches to body 103 by welding, adhesive or other known means. Preferably, yoke 117 and tongue 119 also are fabricated from a single piece of sheet steel, as are body 103, shelf 107, backstop 113 and prongs 109. One having ordinary skill in the art will recognize, too, that tool 101 may be fabricated from other materials, just as may be tool 1, such as molded plastic or the like, without departing from the spirit and scope of the invention.

As best seen in FIG. 7, shank 105 lies against a flat surface depicted for grip 21. Not all golf club grips are so shaped, however, some being substantially oval or circular (neither shown). Unlike tool 1 of the preferred embodiment, which can fit into almost any shaft 25, for tool 101 of the alternate embodiment to be universally useful, it must accommodate a majority of grips of various sizes and shapes or be made in a myriad of configurations itself. Accordingly, yoke 117 is selected with just such motive in mind. Specifically, as shown in FIG. 6, yoke 117 extends perpendicular to body 103 substantially the width of grip 21, thereby substantially receiving the end of grip 21 within mouth 120. Preferably, mouth 120 opens to a width of one and one-fourth (1 ¼") inch, and sidewalls 121 converge to a width of three-fourths (¾") inch at bottom 123. Thus, mouth 120 of yoke 117 as shown is shaped to accommodate most of the myriad of golf club grips available. Shank 105 then is laid parallel and against the outer surface of grip 21 and positioned so that yoke 117 is firmly pressed against grip 21. Attachment strap 118 is coupled to shank 105 and wrapped around the circumference of the combination of grip 21 and shank 105, as discussed above.

As shown in the figures and described above, tool 101 is configured with prongs 109 extending leftward as viewed in FIG. 5. One having ordinary skill in the art will recognize, however, that tool 101 just as easily could be arranged such that prongs 109 extend rightward in FIG. 5, thus allowing for either a righthanded" or "lefthanded" tool 101, depending on the golfer's preference. Unlike the preferred embodiment discussed above, however, which may be reversed for lefthandedness or righthandedness by simply rotating tool 1 180 degrees, tool 101 requires that each type be fabricated separately. This is because simply moving shank 105 to the opposite side of grip 21 not only reverses the direction of prongs 109, but it also relocates them to the other side of grip 21. This further has the effect of merely reversing the position of club 23 head 27 and nothing more. Such relocation can render use of tool 101 much more awkward than tool 1 so reversed because of the distance shelf 107 is displaced from the other position. Though not depicted, this opposite arrangement will be recognized by one having ordinary skill in the art as being within the spirit and scope of the present invention.

In operation, tools 1, 101 are used to lift golf ball 31 from cup 33 without golfer 35 stooping, to repair ball marks and to keep grip 21 clean and dry. As discussed in the sections that follow for tool 1, the principles of operation apply equally to tool 101 because they operate similarly. Where they differ, separate mention of tool 101 will be included.

Figure 8A:
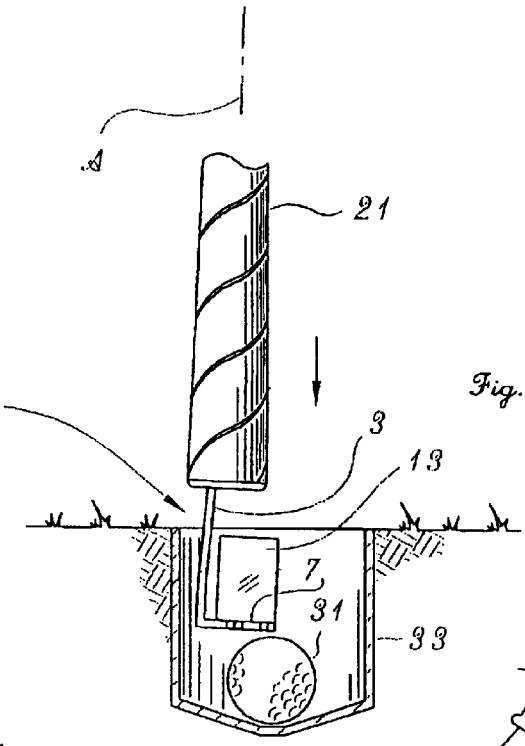
FIGS. 8A and 8B depict in cross section a flag cup in which the preferred embodiment is employed to retrieve a ball.
Figure 8B:
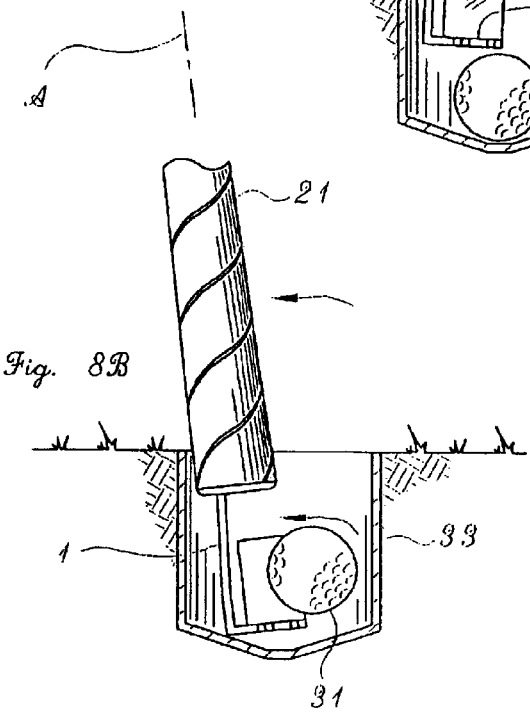
Figure 9:
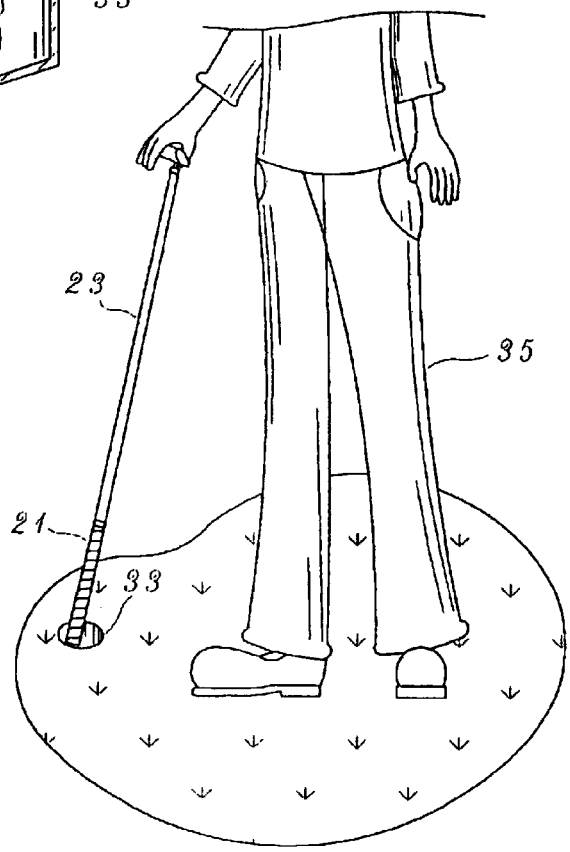
FIG. 9 shows a golfer preparing to lift a golf ball out of a hole, as detailed in FIGS. 8A and 8B, using the present invention.

Referring to FIGS. 8A, 8B and 9, golfer 35 first holds club 23 upright (not shown) and installs the invention onto grip 21 as discussed above for tool 1 or tool 101. Golfer 35 then inverts club 23 and lowers tool 1 into cup 33 adjacent golf ball 31 (FIG. 9). As tool 1 moves to the bottom of cup 33 (FIGS. 8A, 8B), it pushes ball 31 to one side until ball 31 clears shelf 7, whereupon ball 31 rolls onto shelf 7. With a slight tilting motion of club 23, golfer 35 positions ball 31 onto shelf 7 resting against body 3 and backstop 13 (FIG. 8B). Golf ball 31 then can be lifted out of cup 33 in this captive state. Continuing to lift club 23 until he can reach ball 31 with his free hand (not shown), golfer 35 thereby retrieves ball 31 from cup 33 without stooping.

Figure 10:
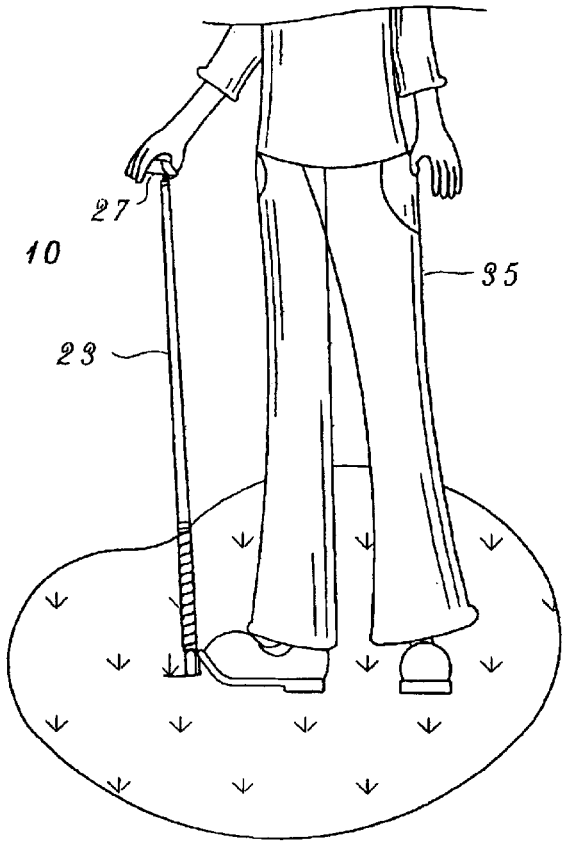
FIG. 10 is a depiction similar to FIG. 9 showing use of the present invention to repair a club divot or ball mark.
Figure 11:
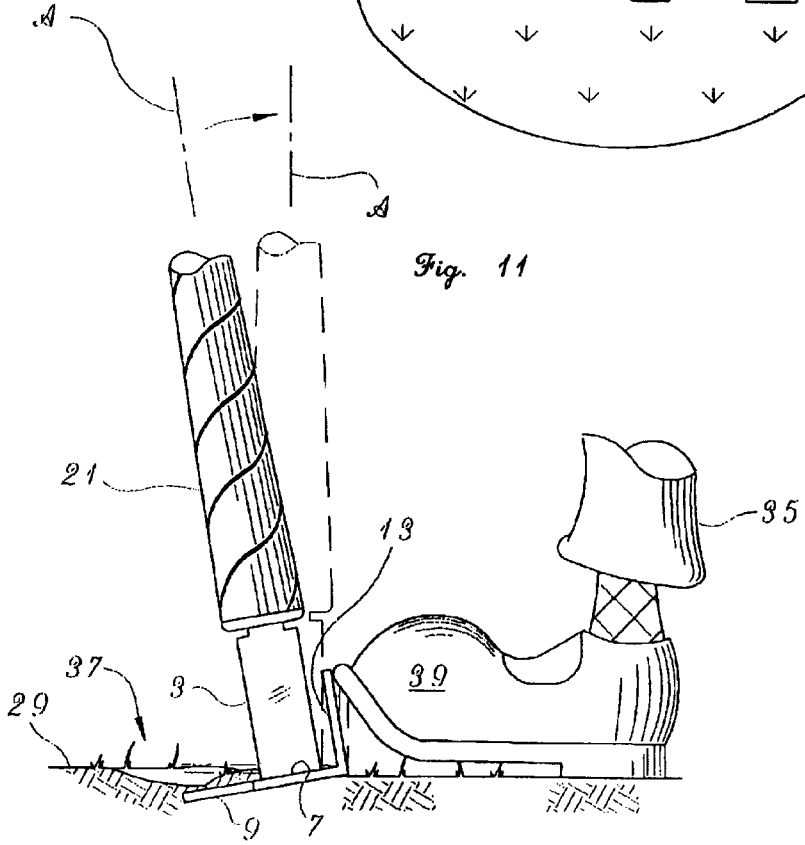
FIG. 11 details the steps in using the present invention to repair a club divot or ball mark, as depicted in FIG. 10.

Turning now to FIGS. 10 and 11, tool 1's use to repair a ball mark is depicted. Assuming tool 1 already is installed, golfer 35 inverts club 23 and holds head 27 in one or both hands. Positioning prongs 9 adjacent ball mark 37, golfer 35 tilts club 23 slightly away from himself to angle prongs 9 downward into ground 29. Golfer 35 then pushes backstop 13 with his toe 39 to force prongs 9 into ground 29 until they extend beneath ball mark 37. Next, golfer 35 rotates club 23 shaft 25 toward himself (phantom lines in FIG. 11) to cause prongs 9 to lift the earth beneath ball mark 37 until it bulges slightly (not shown) above the level of ground 29. Golfer 35 then may tamp the earth now bulging above ball mark 37 as necessary to return it to the level of ground 29, thus eliminating ball mark 37. The entire operation thus can be performed from a standing or sitting position, without golfer 35 having to stoop or bend.

In similar fashion, golfer 35 can retrieve and replace of a divot, or clump of grass dislodged from the ground during play on the fairway. Proper use of irons requires that golfer 35 strike downward, through ball 31. This causes his swing to reach bottom below ground, often causing a clump, or divot, of grass to be thrown forward. Using tool 1, golfer 35 can retrieve this divot by snagging it with prongs 9 and drop it back into the original position, all without bending or stooping. Tool 1 works in this fashion better than a golf club head 27 because of the sharp points of prongs 9, which tend to penetrate the divot and retain it from sliding off.

Figure 12:
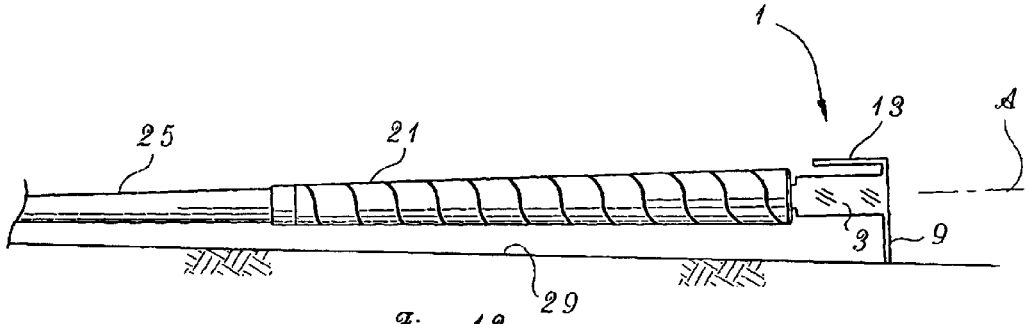
FIGS. 12 and 13 show use of the preferred and alternate embodiments of the present invention to hold the club grip off the ground where the club is laid horizontally.
Figure 13:
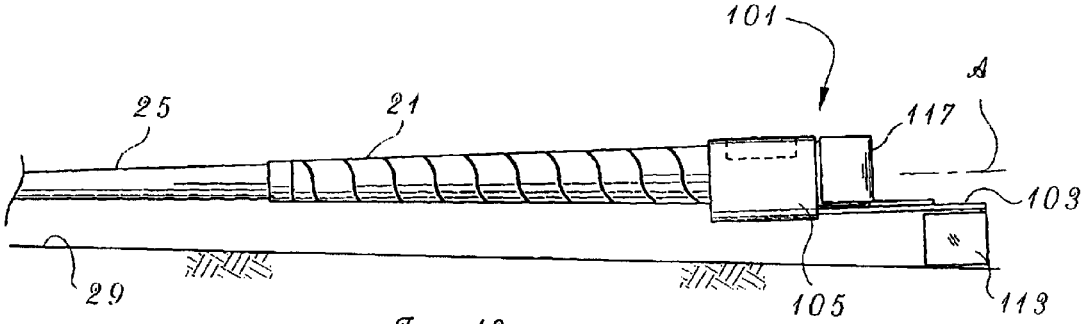

Referring now to FIGS. 12 and 13, use of tools 1 and 101 to keep grip 21 clean and dry is demonstrated. Again assuming tool 1 or 101 is installed onto grip 21 end of club 23, golfer 35 simply lays it on ground 29, largely by placing head 27 onto ground 29 and simply dropping grip 21. As grip 21 falls to ground 29, it brings tools 1, 101 into contact with ground 29 before grip 21 can reach ground 29.

As shown in FIG. 4, tang 5 is oriented parallel to the flat side of grip 21. This flat side of grip 21 typically is installed and oriented on shaft 25 such that it is oriented toward the back of club 23, away from head 27, so that golfer 35's fingers engage it while addressing the ball with club 23. Thus, when tool 1 is inserted into slot 19, prongs 9 become oriented perpendicular to head 27, to one side or the other depending upon which orientation golfer 35 chooses (see discussion above). In either orientation of tool 1, when golfer 35 drops grip 21 to lay club 23 on the ground, he simply notes to which side of grip 21 prongs 9 extend, and drops grip 21 to that side so that prongs 9 engage ground 29 as depicted in FIG. 12.

When using tool 101, golfer likewise drops grip 21 such that the edge of shelf 107 engages ground 29, as depicted in FIG. 13. In this case, tool 101 typically would be installed onto grip 21 with shelf 107 oriented away from head 27 and onto the flat side of grip 21. Because of the extra weight of tool 101, it will cause club 23 to fall such that head 27 points upward from ground 29 (not shown). In fact, because of the extra weight of tool 101, regardless of which side of grip 21 it is installed on, club 23 likely will fall such that shelf 107 engages ground 29 as depicted in FIG. 13.

Thus, grip 21 will remain suspended above ground 29 as depicted in FIGS. 12, 13 until golfer 35 retrieves club 23. Grip 21 stays above ground 29, avoiding becoming soiled or damp from moisture on ground 29. To retrieve club 23, golfer 35 can hook another golf club under shaft 25 or under grip 21 (not shown) and raise grip 21 end of club 23 to a position where he can grasp it with his free hand. Neither dropping nor retrieving club 23 as described requires golfer 35 to stoop or bend in the process.

Finally, tools 1, 101 may be employed to retrieve other objects from the ground, such as other clubs, the pin flag or the like. Simply slipping prongs 9, 109 under the shaft (not shown) of the pin flag or a club shaft and lifting can elevate the club grip or the flag so that golfer 35 need not stoop to pick them up. Likewise, tools 1, 101 can be employed in similar fashion to retrieve ball 31 from the surface of ground 29, whether flat or not. Golfer 35 simply would place shelf 7, 107 adjacent ball 31 and urge ball 31 onto shelf 7, 107, using his toe 39 if necessary, while gently tilting shaft 25 away from himself until ball 31 rests against body 3, 103 and backstop 13, 113, then lifting club 23 until he can secure ball 31 with his other hand without stooping or bending.

The present invention, described in either its preferred or alternate embodiment, thus serves a golfer of limited physical mobility in performing many of the functions required to participate in the sport of golf. This invention allows a person to retrieve a golf ball 31, to repair a golf ball mark 37, to retrieve a golf club 23 lying on the ground and to replace a divot on the fairway, all without bending or stooping.

While the invention has been particularly shown and described with reference to one or more embodiments, it will be understood by those skilled in the art that various changes in form and detail may be made therein without departing from the spirit and scope of the invention. For example, the figures depict backstop 13, 113 as having a width approximately that of golf ball 31, but substantial variations in the width of backstop 13, 113 may be appropriate to keep golf ball 31 captive. Likewise, the length of body 3 can have substantial variations and still allow golfer 35 to perform all of the intended functions of tool 1, 101. Also, instead of strap 105, tool 101 could attach by means of a rubberized cup stretched and fitted onto the end of grip 21 with the body 3 being coupled to the cup.

Further, the orientation of prongs 9, 109 is chosen to enhance golfer 35's ease in repairing ball marks while standing, as depicted in FIG. 10, while cooperating in ball retrieval from a flag cup, as depicted in FIG. 9. Prongs 9, 109 could, however, extend in a different plane from shelf 7, 107 to change the angle (FIGS. 10, 11) at which shaft 25 is held while repairing ball mark 37.

I claim:

1. A golf ball retrieval tool comprising an elongated handle having a longitudinal axis;

a tool having a body coupled to one end of the handle and extending substantially parallel the longitudinal axis;

a shelf disposed on an end of the body distal the handle and substantially perpendicular to the body;

a backstop coupled to the shelf and disposed substantially perpendicular to both the shelf and the body, wherein the body, the shelf and the backstop define an open-cornered support for a golf ball;

a plurality of prongs disposed on and extending from the shelf opposite the backstop; and coupling means for coupling the tool to the handle.

2. The retrieval tool according to claim 1 wherein the prongs extend coplanar with the shelf opposite the backstop.

3. The retrieval tool according to claim 1 wherein the coupling means comprises a tang extending longitudinally from an end of the body proximate the handle; and a plug coupled to a shaft inside the handle, the plug surrounding and defining a slot adapted to receive and frictionally grasp the tang.

4. The retrieval tool according to claim 3 wherein the plug is adapted to receive the tang in a plurality of angular positions about the longitudinal axis.

5. The retrieval tool according to claim 3 wherein the plug further comprises a cap having a dimension larger than an inside dimension of the shaft.

6. The retrieval tool according to claim 1 wherein the coupling means comprises a strap coupled to the body and adapted to wrap around the handle to secure the body to the handle.

7. The retrieval tool according to claim 1 wherein the coupling means comprises a plate disposed on a side of, and oriented substantially perpendicular to, the tool body and adapted to contact an end of the handle; and a strap coupled to the body and adapted to wrap around the handle to secure the body to the handle.

8. The retrieval tool according to claim 7 wherein the plate comprises a yoke having a mouth opening open toward the handle and adapted to receive the end of the handle within the mouth.

9. The retrieval tool according to claim 1 wherein the backstop is disposed on an end of the shelf a spaced distance apart from the body to define a gap adapted to receive storage means for the tool.

10. The retrieval tool according to claim 1 wherein the handle comprises a golf club having a head and a grip on opposite ends of a shaft; and the tool removably couples to the grip.

11. The retrieval tool according to claim 10 wherein the coupling means comprises a tang extending longitudinally from the proximate end of the body; and a plug coupled to a shaft inside the handle, the plug surrounding and defining an slot adapted to receive and frictionally grasp the tang.

12. The retrieval tool according to claim 11 wherein the plug further comprises a cap having a dimension larger than an inside dimension of the shaft.

13. A golf ball retrieval tool comprising an elongated handle having a longitudinal axis and an inside surface;

a plug coupled to the inside surface;

a tool head having a body coupled to and extending from the plug;

a shelf disposed on an end of the body distal the handle and substantially perpendicular to the body;

a backstop coupled to the shelf and disposed substantially perpendicular to both the shelf and the body, whereby the body, the shelf and the backstop define an open-cornered support for a golf ball; and two tapered prongs disposed on the shelf and extending from the shelf opposite the backstop.

14. An improved method of retrieving a golf ball, the method comprising providing a golf ball retrieval tool having an elongated handle having a longitudinal axis extending between two opposite ends;

a tool adapted to couple to the handle and having a body extending substantially parallel the longitudinal axis;

a shelf disposed on the body distal the handle substantially perpendicular to the body; and a backstop coupled to the shelf and disposed substantially perpendicular to both the shelf and the body a spaced distance apart from the body to define a gap adapted to receive storage means for the tool; then coupling the tool to the handle; then grasping the end of the handle opposite the tool; then lowering the tool into a cup containing a golf ball; then positioning the shelf near a lower portion of the golf ball; then tilting the handle to urge the golf ball onto the shelf; then raising the handle upward to retrieve the ball from the cup.

15. The improved method of retrieving a golf ball of claim 14 wherein the step of coupling the tool to the handle further comprises providing a tang extending longitudinally from the proximate end of the body; and a plug coupled to a shaft inside the handle and surrounding and defining a slot adapted to receive and frictionally grasp the tang; then inserting the tang into the slot; then pressing the tool towards the handle along the longitudinal axis of the handle.

16. The improved method of retrieving a golf ball of claim 14 wherein the step of coupling the tool to the handle comprises providing a shank disposed on the body and extending longitudinally away from the body;

a yoke disposed on a side of the tool body and having an opening oriented away from the shelf and adapted to receive an end of the handle; and a strap coupled to the shank; then positioning the tool with the shank adjacent the handle with the end of the handle received within the opening of the yoke, then wrapping the strap around the handle to secure the tool to the handle.

17. An improved method of repairing a golf ball mark, the method comprising providing a golf ball retrieval tool having an elongated handle having a longitudinal axis extending between two opposite ends;

a tool adapted to couple to the handle and having a body extending substantially parallel the longitudinal axis;

a shelf disposed on the body distal the handle and substantially perpendicular to the body;

a backstop coupled to the shelf and disposed substantially perpendicular to both the shelf and the body; and a plurality of prongs disposed on and extending from the shelf opposite the backstop; then coupling the tool to the handle; then grasping the end of the handle opposite the tool; then positioning the prongs against the ground near the ball mark such that the prongs are adapted penetrate the ground beneath a bottom of the ball mark; then applying to pressure to the backstop to urge the prongs to penetrate the ground are under the ball mark; then rotating the handle to lift the prongs and elevate the bottom of the ball mark.

18. The improved method of repairing a golf ball mark of claim 17 wherein the step of coupling the tool to the handle further comprises;

providing a tang extending longitudinally from the body; and a plug coupled to a shaft inside the handle and surrounding and defining a slot adapted to receive and frictionally grasp the tang; then inserting the tang into the slot; then pressing the tool towards the handle along the longitudinal axis of the handle.

19. The improved method of repairing a golf ball mark of claim 17 wherein the step of coupling the tool to the handle further comprises;

providing a shank disposed on and extending longitudinally away from the body;

a yoke disposed on a side of the body and having an opening oriented away from the shelf, the opening adapted to receive one end of the handle; and a strap coupled to a shank; then positioning the tool with the shank adjacent the handle with the end of the handle received within the opening of the yoke; then wrapping the strap around the handle to secure the tool to the handle.

20. An improved method of preventing a golf club grip from contacting the ground during use, the golf club having a shaft having a longitudinal axis extending between two opposite ends, a head on one end and a grip on the opposite end, the method comprising providing a golf ball retrieval tool adapted to couple to the grip and having a body extending substantially parallel the longitudinal axis;

a shelf disposed on the body distal the handle and substantially perpendicular to the body;

a backstop coupled to the shelf and disposed substantially perpendicular to both the shelf and the body a spaced distance apart from the body to define a gap adapted to receive storage means for the tool; and coupling means for coupling the tool to the grip; then coupling the tool to the grip; then grasping the golf club by the grip and laying the head onto the ground; then laying the golf club down substantially parallel to the ground until the tool contacts the ground whereby a gap remains between the grip and the ground; then retrieving the golf club from the ground by inserting lifting means between the grip and the ground and lifting the grip.

21. A golf ball retrieval tool comprising an elongated handle having a longitudinal axis;

a tool having a body coupled to one end of the handle and extending substantially parallel the longitudinal axis;

a shelf disposed on an end of the body distal the handle and substantially perpendicular to the body;

a backstop coupled to the shelf and disposed substantially perpendicular to both the shelf and the body a spaced distance apart from the body to define a gap between the backstop and the body adapted to receive storage means for the tool; and coupling means for coupling the tool to the handle.

22. The retrieval tool according to claim 21 wherein the coupling means comprises a tang extending longitudinally from an end of the body proximate the handle; and a plug coupled to a shaft inside the handle, the plug surrounding and defining a slot adapted to receive and frictionally grasp the tang.

23. The retrieval tool according to claim 21 wherein the coupling means comprises a strap coupled to the body and adapted to wrap around the handle to secure the body to the handle.

24. The retrieval tool according to claim 21 wherein the coupling means comprises a plate disposed on a side of, and oriented substantially perpendicular to, the tool body and adapted to contact an end of the handle; and a strap coupled to the body and adapted to wrap around the handle to secure the body to the handle.

25. The retrieval tool according to claim 24 wherein the plate comprises a yoke having a mouth opening open toward the handle and adapted to receive the end of the handle within the mouth.

* * * * *